US010937351B2

(12) United States Patent
Meng et al.

(10) Patent No.: US 10,937,351 B2
(45) Date of Patent: Mar. 2, 2021

(54) GAMMA-CURVE CORRECTION METHOD FOR DISPLAY APPARATUS AND DISPLAY APPARATUS

(71) Applicant: BOE TECHNOLOGY GROUP CO., LTD., Beijing (CN)

(72) Inventors: Song Meng, Beijing (CN); Quanhu Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/774,175

(22) PCT Filed: Oct. 13, 2017

(86) PCT No.: PCT/CN2017/106061
§ 371 (c)(1),
(2) Date: May 7, 2018

(87) PCT Pub. No.: WO2018/153108
PCT Pub. Date: Aug. 30, 2018

(65) Prior Publication Data

US 2019/0108780 A1 Apr. 11, 2019

(30) Foreign Application Priority Data

Feb. 27, 2017 (CN) ..... 201710107355.4

(51) Int. Cl.
*G09G 5/10* (2006.01)
*G09G 3/20* (2006.01)
*G09G 3/00* (2006.01)

(52) U.S. Cl.
CPC ..... *G09G 3/2003* (2013.01); *G09G 3/006* (2013.01); *G09G 3/20* (2013.01); *G09G 2320/0276* (2013.01); *G09G 2320/0673* (2013.01)

(58) Field of Classification Search
CPC ..... G09G 3/2003; G09G 3/20; G09G 2320/0276; G09G 2320/0673;
(Continued)

(56) References Cited

U.S. PATENT DOCUMENTS

2005/0201615 A1 9/2005 Hsu et al.
2007/0052735 A1* 3/2007 Chou ..... H04N 9/69 345/690
(Continued)

FOREIGN PATENT DOCUMENTS

CN 101071536 A 11/2007
CN 103295506 A 9/2013
(Continued)

OTHER PUBLICATIONS

International Search Report dated Jan. 12, 2018.
First Chinese Office Action dated Mar. 4, 2019.

*Primary Examiner* — Adam R. Giesy
(74) *Attorney, Agent, or Firm* — Dilworth & Barrese, LLP.; Michael J. Musella, Esq.

(57) ABSTRACT

A Gamma-curve correction method for a display apparatus, and a display apparatus. The method includes: determining a standard Gamma curve according to the display apparatus; selecting a plurality of test gray scale values on the standard Gamma curve, and acquiring a plurality of target brightness values corresponding to the plurality of test gray scale values; adjusting an input gray scale value of the display apparatus to obtain a plurality of test-correction gray scale values, where the test-correction gray scale values are corresponding input gray scale values when display brightness of the display apparatus is equal to respective target brightness; generating an association relationship between input gray scale values and correction gray scale values, according to the plurality of test gray scale values and the plurality of test-correction gray scale values; and adjusting the input
(Continued)

gray scale value to a corresponding correction gray scale value, according to the association relationship.

19 Claims, 2 Drawing Sheets

(58) Field of Classification Search
CPC ... G09G 2320/0666; G09G 2320/0271; G09G 2320/029; G09G 2320/0693
See application file for complete search history.

(56) References Cited

U.S. PATENT DOCUMENTS

| | | | | |
|---|---|---|---|---|
| 2015/0243198 | A1 | 8/2015 | Zhang et al. | |
| 2015/0302788 | A1* | 10/2015 | Kim | G09G 3/2007 345/690 |
| 2016/0140891 | A1* | 5/2016 | Lim | G09G 3/2003 345/690 |
| 2016/0260368 | A1 | 9/2016 | Zheng | |
| 2017/0046995 | A1 | 2/2017 | Chen et al. | |

FOREIGN PATENT DOCUMENTS

| | | | |
|---|---|---|---|
| CN | 103926714 | A | 7/2014 |
| CN | 104064156 | A | 9/2014 |
| CN | 105096827 | A | 11/2015 |
| CN | 105741775 | A | 7/2016 |
| CN | 105869567 | A | 8/2016 |
| CN | 105869587 | A | 8/2016 |
| CN | 106782283 | A | 5/2017 |

* cited by examiner

GAMMA-CURVE CORRECTION METHOD FOR DISPLAY APPARATUS AND DISPLAY APPARATUS

TECHNICAL FIELD

Embodiments of the present disclosure relate to a Gamma-curve correction method for a display apparatus and a display apparatus.

BACKGROUND

Visual characteristics of human eyes have a nonlinear relationship with brightness of a surrounding environment, and thus, an existing display apparatus can carry out Gamma correction on an output image using a preset Gamma curve so as to meet visual requirements of the human eyes. However, in the existing display apparatus, the preset Gamma curve is implemented by an algorithm and is not corrected by an optical device, and a finally-generated Gamma curve often has a deviation from a standard Gamma curve, i.e., the generated Gamma curve is inaccurate, so that quality of the output image is influenced.

SUMMARY

Embodiments of the disclosure provide a Gamma-curve correction method for a display apparatus, comprising:

determining a standard Gamma curve according to the display apparatus;

selecting a plurality of test gray scale values on the standard Gamma curve, and acquiring a plurality of target brightness values corresponding to the plurality of test gray scale values;

adjusting an input gray scale value of the display apparatus to obtain a plurality of test-correction gray scale values, wherein the test-correction gray scale values are corresponding input gray scale values when display brightness of the display apparatus is equal to respective target brightness;

generating an association relationship between input gray scale values and correction gray scale values of the display apparatus, according to the plurality of test gray scale values and the plurality of test-correction gray scale values; and adjusting the input gray scale value of the display apparatus to a corresponding correction gray scale value, according to the association relationship.

In some implementations, selecting the plurality of test gray scale values on the standard Gamma curve includes: selecting the plurality of test gray scale values at a fixed preset interval on the standard Gamma curve.

In some implementations, the fixed preset interval is equal to 4 or 8 gray scale units.

In some implementations, selecting the plurality of test gray scale values on the standard Gamma curve includes: selecting test gray scale values in a low-gray-scale region and/or a high-gray-scale region of the standard Gamma curve at a first preset interval, and selecting test gray scale values in other regions of the standard Gamma curve at a second preset interval, the first preset interval being smaller than the second preset interval.

In some implementations, generating the association relationship between the input gray scale values and the correction gray scale values of the display apparatus includes: by a fitting method, generating the association relationship between the input gray scale values and the correction gray scale values of the display apparatus.

In some implementations, the association relationship includes:

$$GL'=A*GL+B*[1-e-GL/C],$$

where GL' represents the correction gray scale value, GL represents the input gray scale value of the display apparatus, and A, B and C represent constant coefficients determined by the fitting method.

In some implementations, generating the association relationship between the input gray scale values and the correction gray scale values of the display apparatus includes: by an interpolation method, generating the association relationship between the input gray scale values and the correction gray scale values of the display apparatus.

In another aspect, embodiments of the disclosure further provide a display apparatus for applying the Gamma-curve correction method described above, comprising: a correction module, configured to adjust an input gray scale value of the display apparatus to a corresponding correction gray scale value according to an association relationship between input gray scale values and correction gray scale values of the display apparatus.

In some implementations, the display apparatus further comprises a test module and an association module. The test module is configured to: determine a standard Gamma curve according to the display apparatus; select a plurality of test gray scale values on the standard Gamma curve, and acquire a plurality of target brightness values corresponding to the plurality of test gray scale values; and adjust the input gray scale value of the display apparatus to obtain a plurality of test-correction gray scale values, wherein the test-correction gray scale values are corresponding input gray scale values when display brightness of the display apparatus is equal to respective target brightness. The association module is configured to, according to the plurality of test gray scale values and the plurality of test-correction gray scale values, generate the association relationship between the input gray scale values and the correction gray scale values of the display apparatus.

In some implementations, the test module is configured to select the plurality of test gray scale values at a fixed preset interval on the standard Gamma curve.

In some implementations, the test module is configured to: select test gray scale values in a low-gray-scale region and/or a high-gray-scale region of the standard Gamma curve at a first preset interval, and select test gray scale values in other regions of the standard Gamma curve at a second preset interval, the first preset interval being smaller than the second preset interval.

In some implementations, the association module is configured to generate the association relationship between the input gray scale values and the correction gray scale values of the display apparatus by a fitting method.

In some implementations, the association relationship includes:

$$GL'=A*GL+B*[1-e-GL/C],$$

where GL' represents the correction gray scale value, GL represents the input gray scale value of the display apparatus, and A, B and C represent constant coefficients determined by the fitting method.

In some implementations, the association module is configured to generate the association relationship between the input gray scale values and the correction gray scale values of the display apparatus by an interpolation method.

In yet another aspect, embodiments of the disclosure further provide a storage medium, storing computer instructions suitable to be operated by a processor, wherein when the computer instructions are operated by the processor, the Gamma-curve correction method for the display apparatus described above is executed.

BRIEF DESCRIPTION OF THE DRAWINGS

In order to illustrate the technical solutions in the embodiments of the present disclosure or the existing arts more clearly, the drawings needed to be used in the description of the embodiments or the existing arts will be briefly described in the following; it is obvious that the drawings described below are only related to some embodiments of the present disclosure, for one ordinary skilled person in the art, other drawings can be obtained according to these drawings without making other inventive work.

DETAILED DESCRIPTION

In order to make objects, technical details and advantages of the disclosure more apparent, the disclosure will be further illustrated in detail in connection with specific embodiments with reference to the drawings.

It should be noted that in the present disclosure, terms such as "first" and "second" are intended to distinguish different entities or different parameters with the same name, and it is thus clear that "first" and "second" merely intend to facilitate expression, but should not be understood as limitation to the embodiments of the present disclosure. Similar description will not be repeated in the subsequent embodiments.

An embodiment of the present disclosure provides a Gamma-curve correction method for a display apparatus. According to the method, an experimental test is carried out for each display apparatus; an association relationship between input gray scale values and correction gray scale values, which particularly belongs to the display apparatus, is calculated on the basis of data obtained by the experimental test and related theoretical values; and then by configuring a correction module in the display apparatus, when the display apparatus operates, the display apparatus can adjust an input gray scale value to a correction gray scale value according to the association relationship, thereby reaching a Gamma-curve correction effect and improving quality of an output image of the display apparatus.

Figure 1:
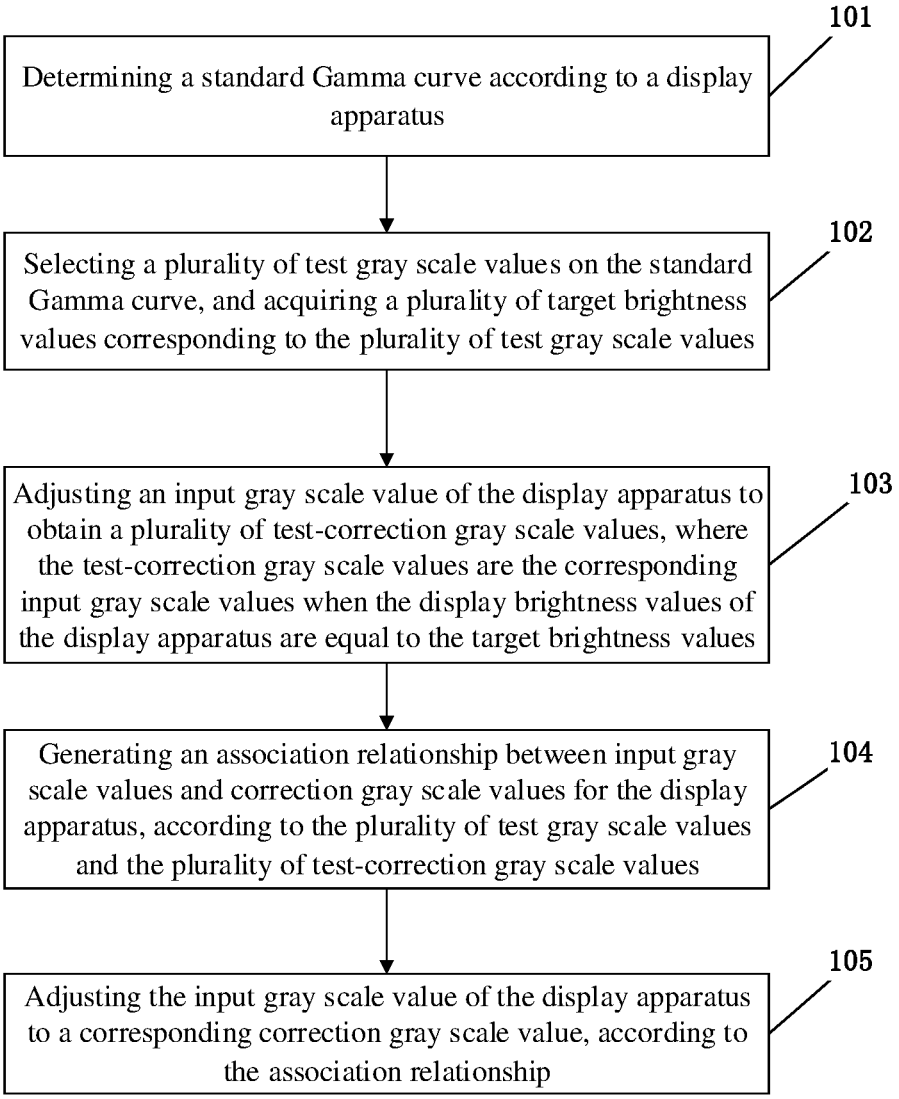
FIG. 1 is a flow chart of a Gamma-curve correction method for a display apparatus provided by an embodiment of the present disclosure.

With reference to FIG. 1, FIG. 1 is a flow chart of a Gamma-curve correction method for a display apparatus, which is provided by an embodiment of the present disclosure.

The Gamma-curve correction method includes, but is not limited to, step S101 to step S105 below:

S101: determining a standard Gamma curve according to the display apparatus.

In this step, according to inherent parameters of a current display apparatus which needs to be subjected to Gamma curve correction, the standard Gamma curve is determined. For example, a preset Gamma curve of a common computer display is a Gamma 2.2 curve ($L=L_{max}\times(GL/1024)^{2.2}$, where L represents output a brightness of the display apparatus, $L_{max}$ represents a maximum output brightness of the display apparatus, and GL represents an input gray scale value of the display apparatus), and then the determined standard Gamma curve in this step is the Gamma 2.2 curve. Obviously, when the preset Gamma curve of the display apparatus is another Gamma curve, such as a Gamma 2.8 curve or a special-value Gamma curve, correspondingly in this step, the determined Gamma curve is a Gamma 2.8 curve or a special-value Gamma curve.

S102: selecting a plurality of test gray scale values on the standard Gamma curve, and acquiring a plurality of target brightness values corresponding to the plurality of test gray scale values.

In this step, firstly, a plurality of test gray scale values are selected on the determined standard Gamma curve; and then for each test gray scale value, an output brightness theoretical value of the display apparatus, which corresponds to the test gray scale value, is calculated by the standard Gamma curve, and the output brightness theoretical value is used as a target brightness value corresponding to the test gray scale value. The above-mentioned computing process is carried out for each test gray scale value, and finally, the plurality of target brightness values corresponding to the plurality of test gray scale values are obtained. Obviously, the plurality of test gray scale values and the plurality of target brightness values are in a one-to-one corresponding relationship.

For example, when a plurality of test gray scale values are selected, the plurality of test gray scale values are selected at a fixed preset interval on the standard Gamma curve. When the plurality of test gray scale values are selected at the fixed preset interval, interval gray scale units between any two adjacent test gray scale values are the same, and the plurality of finally-selected test gray scale values are regularly continuous in value, so that the method provided by the embodiments has wide-range applicability, and can be applicable to most of the common display apparatuses. According to actual measurement experience, the fixed preset interval, for example, may be set as 4 or 8 gray scale units. Obviously, according to actual test requirements or use requirements, the fixed preset interval can be flexibly selected.

For another example, when a plurality of test gray scale values are selected, test gray scale values are selected at a first preset interval in a low-gray-scale region and/or a high-gray-scale region of the standard Gamma curve, and test gray scale values are selected at a second preset interval in other regions of the standard Gamma curve, and the first preset interval is smaller than the second preset interval. In a common display apparatus, a low-gray-scale region and a high-gray-scale region of the preset Gamma curve of the common display apparatus more frequently have a problem of gray scale loss or insufficient expansion, i.e., the low-gray-scale region and the high-gray-scale region of the preset Gamma curve are more likely to be inaccurate than other regions. To solve this problem, in an embodiment, when the test gray scale values are selected on the standard Gamma curve, the smaller first preset interval is used in the low-gray-scale region and the high-gray-scale region of the standard Gamma curve so as to select a greater number of test gray scale values; and a smaller number of test gray scale values are selected with the larger second preset interval in other regions of the standard Gamma curve. Therefore, on the premise of ensuring that workload is not obviously increased, by selecting more test gray scale values in the low-gray-scale region and/or the high-gray-scale region of the preset Gamma curve, a subsequent correction result is more accurate in the low-gray-scale region and/or the high-gray-scale region, which particularly solves the problem of gray scale loss or insufficient expansion in the low-gray-scale region and/or the high-gray-scale region of the common display apparatus.

Certainly, when a plurality of test gray scale values are selected, test gray scale values in the low-gray-scale region of the standard Gamma curve are selected at a first preset interval, test gray scale values in the high-gray-scale region of the standard Gamma curve are selected at a second preset interval, and test gray scale values in other regions of the standard Gamma curve are selected at a third preset interval, where both the first preset interval and the second preset interval are smaller than the third preset interval, and the first preset interval can be smaller than, greater than or equal to the second preset interval (which is not limited in the present disclosure).

S103: adjusting an input gray scale value of the display apparatus to enable display brightness values of the display apparatus to be respectively equal to the plurality of target brightness values so as to obtain a plurality of test-correction gray scale values, where the test-correction gray scale values are the corresponding input gray scale values when the display brightness values of the display apparatus are equal to the target brightness values respectively.

In this step, in a process of powering up the display apparatus to carry out normal display, the input gray scale value of the display apparatus is adjusted to enable output brightness of the display apparatus to be equal to the target brightness, and then the current input gray scale value of the display apparatus is recorded and used as a test-correction gray scale value. For each target brightness, the above-mentioned operation process is carried out, so that finally, a plurality of test-correction gray scale values are obtained. Obviously, due to the one-to-one corresponding relationship between the plurality of target brightness values and the plurality of test gray scale values, by the above-mentioned process, the plurality of obtained test-correction gray scale values and the plurality of obtained test gray scale values are also in a one-to-one corresponding relationship.

S104: generating an association relationship between input gray scale values and correction gray scale values for the display apparatus, according to the plurality of test gray scale values and the plurality of test-correction gray scale values.

In this step, by using the plurality of test gray scale values and the plurality of test-correction gray scale values, which are obtained in the above-mentioned steps, and by using a mathematical method, a function relation between them can be established, and the function relation can show the association relationship between the input gray scale values and the correction gray scale values for the display apparatus.

Further, according to the one-to-one corresponding relationship between the plurality of test gray scale values and the plurality of test-correction gray scale values, the test gray scale value is used as an independent variable, the test-correction gray scale value is used as a variable, a function relation can be generated by a fitting method or an interpolation method, and the generated function relation shows the association relationship between the input gray scale values and the correction gray scale values for the display apparatus.

S105: adjusting an input gray scale value of the display apparatus to a correction gray scale value, according to the association relationship.

In this step, a correction module which can carry out computing operations on gray scale value data on the basis of the association relationship is arranged in the display apparatus, and the correction module is arranged in a control panel of the display apparatus by a programming approach and is used for achieving a correction function. For example, when the display apparatus operates, the correction module can adjust an input gray scale value of the display apparatus to a correction gray scale value in real time according to the association relationship. By adjusting the input gray scale values of the display apparatus to the correction gray scale values, a Gamma correction effect of the display apparatus in the actual working process is closer to the preset standard Gamma curve thereof, an effect of carrying out correction on the Gamma curve of the display apparatus is achieved, and the quality of the output image of the display apparatus is significantly promoted.

Moreover, besides using the above-mentioned software mode, the step can also be implemented by arranging a separate hardware module in the display apparatus. The hardware module can be a programmable chip, and can also be an arithmetic circuit constructed by general electronic components. That is, the correction module can be implemented by way of software, hardware or a combination thereof.

Based on the above-mentioned embodiment, the method provided by an embodiment of the present disclosure will be further illustrated below by a specific operation example.

In the step S101, the display apparatus which needs to be corrected is selected, a data-bit width used when the selected display apparatus operates is 10 bits, the maximum output brightness $L_{max}$ is 400, and the preset Gamma curve of the selected display apparatus is the Gamma 2.2 curve: $L=L_{max}\times(GL/1024)^{2.2}$. The standard Gamma curve determined in the step S101 is the Gamma 2.2 curve correspondingly.

In the step S102, a plurality of test gray scale values are selected at a fixed preset interval on the Gamma 2.2 curve, and the fixed preset interval is equal to 8 gray scale units. The obtained test gray scale values can be referred to in a first column of data in Table 1. Then, according to the Gamma 2.2 curve, the target brightness respectively corresponding to the test gray scale values is obtained. The obtained target brightness can be referred to in a second column of data in Table 1.

In the step S103, the display apparatus is powered up to operate, an input gray scale value of the display apparatus is adjusted to enable the output brightness of the display apparatus to be equal to the corresponding target brightness, and then the current input gray scale value of the display apparatus is recorded and used as a corresponding test-correction gray scale value. The obtained test-correction gray scale values can be referred to in a third column of data in Table 1.

TABLE 1

| Actual Measured Data | | |
|---|---|---|
| Test Gray Scale Values | Target Brightness | Test-correction gray scale values |
| 0 | 0 | 0 |
| 8 | 0.009 | 28 |
| 16 | 0.043 | 41 |
| 24 | 0.104 | 51 |
| 32 | 0.196 | 65 |
| 40 | 0.32 | 79 |
| 48 | 0.478 | 91 |
| 56 | 0.67 | 100 |
| 64 | 0.899 | 111 |
| 72 | 1.165 | 121 |
| 80 | 1.469 | 130 |

TABLE 1-continued

| Actual Measured Data | | |
|---|---|---|
| Test Gray Scale Values | Target Brightness | Test-correction gray scale values |
| 88 | 1.812 | 140 |
| 96 | 2.194 | 149 |
| 104 | 2.617 | 159 |
| 112 | 3.08 | 167 |
| 120 | 3.585 | 176 |
| 128 | 4.132 | 184 |
| 136 | 4.722 | 193 |
| 144 | 5.355 | 200 |
| 152 | 6.031 | 209 |
| 160 | 6.751 | 217 |
| 168 | 7.516 | 225 |
| 176 | 8.326 | 233 |
| 184 | 9.182 | 241 |
| 192 | 10.083 | 249 |
| 200 | 11.031 | 257 |
| 208 | 12.025 | 264 |
| 216 | 13.066 | 272 |
| 224 | 14.154 | 280 |
| 232 | 15.29 | 288 |
| 240 | 16.474 | 295 |
| 248 | 17.706 | 303 |
| 256 | 18.987 | 311 |
| 264 | 20.317 | 319 |
| 272 | 21.696 | 326 |
| 280 | 23.125 | 334 |
| 288 | 24.604 | 342 |
| 296 | 26.132 | 349 |
| 304 | 27.711 | 357 |
| 312 | 29.341 | 365 |
| 320 | 31.022 | 373 |
| 328 | 32.753 | 380 |
| 336 | 34.537 | 388 |
| 344 | 36.372 | 398 |
| 352 | 38.258 | 403 |
| 360 | 40.198 | 410 |
| 368 | 42.189 | 418 |
| 376 | 44.233 | 425 |
| 384 | 46.33 | 432 |
| 392 | 48.48 | 440 |
| 400 | 50.683 | 447 |
| 408 | 52.94 | 455 |
| 416 | 55.251 | 462 |
| 424 | 57.615 | 470 |
| 432 | 60.034 | 477 |
| 440 | 62.507 | 484 |
| 448 | 65.035 | 491 |
| 456 | 67.617 | 499 |
| 464 | 70.254 | 506 |
| 472 | 72.947 | 513 |
| 480 | 75.694 | 520 |
| 488 | 78.498 | 528 |
| 496 | 81.357 | 536 |
| 504 | 84.272 | 543 |
| 512 | 87.242 | 550 |
| 520 | 90.269 | 557 |
| 528 | 93.353 | 565 |
| 536 | 96.493 | 573 |
| 544 | 99.69 | 580 |
| 552 | 102.944 | 587 |
| 560 | 106.254 | 595 |
| 568 | 109.623 | 602 |
| 576 | 113.048 | 609 |
| 584 | 116.531 | 617 |
| 592 | 120.072 | 624 |
| 600 | 123.671 | 631 |
| 608 | 127.327 | 638 |
| 616 | 131.042 | 646 |
| 624 | 134.815 | 653 |
| 632 | 138.647 | 660 |
| 640 | 142.538 | 668 |
| 648 | 146.487 | 675 |
| 656 | 150.495 | 682 |
| 664 | 154.562 | 689 |
| 672 | 158.689 | 696 |
| 680 | 162.875 | 703 |

TABLE 1-continued

| Actual Measured Data | | |
|---|---|---|
| Test Gray Scale Values | Target Brightness | Test-correction gray scale values |
| 688 | 167.12 | 711 |
| 696 | 171.425 | 718 |
| 704 | 175.79 | 726 |
| 712 | 180.214 | 733 |
| 720 | 184.699 | 740 |
| 728 | 189.244 | 748 |
| 736 | 193.85 | 755 |
| 744 | 198.515 | 762 |
| 752 | 203.242 | 769 |
| 760 | 208.029 | 776 |
| 768 | 212.877 | 783 |
| 776 | 217.786 | 790 |
| 784 | 222.756 | 797 |
| 792 | 227.787 | 804 |
| 800 | 232.88 | 811 |
| 808 | 238.034 | 819 |
| 816 | 243.249 | 826 |
| 824 | 248.527 | 833 |
| 832 | 253.866 | 840 |
| 840 | 259.267 | 847 |
| 848 | 264.731 | 854 |
| 856 | 270.256 | 862 |
| 864 | 275.844 | 869 |
| 872 | 281.494 | 876 |
| 880 | 287.207 | 883 |
| 888 | 292.983 | 890 |
| 896 | 298.821 | 897 |
| 904 | 304.722 | 904 |
| 912 | 310.686 | 911 |
| 920 | 316.714 | 918 |
| 928 | 322.804 | 925 |
| 936 | 328.958 | 932 |
| 944 | 335.175 | 939 |
| 952 | 341.456 | 946 |
| 960 | 347.801 | 953 |
| 968 | 354.209 | 960 |
| 976 | 360.681 | 967 |
| 984 | 367.217 | 974 |
| 992 | 373.817 | 981 |
| 1000 | 380.482 | 988 |
| 1008 | 387.21 | 995 |
| 1016 | 394.003 | 1003 |

In the step S104, by using the actual measured data (the first column and third column of data in Table 1) of the test gray scale values and the test-correction gray scale values and using a fitting method, a function relation is established:

$$GL'=A*GL+B*[1-e^{-GL/C}],$$

where GL' represents a correction gray scale value, GL represents an input gray scale value of the display apparatus, and A, B and C represent constant coefficients determined by the fitting method.

By using the actual measured data of the test gray scale values and the test-correction gray scale values, through calculation, specific values of A, B and C are determined. Further, in order to improve accuracy of the result, a segmented function relation is established with a segmented processing approach. For example, the test gray scale value GL is divided into three segments: GL∈[0-64]; GL∈[64-352]; and GL∈[352-1016]. By calculation, an obtained result is that: when GL∈[0-64], A=1.49, B=17.31 and C=3.06; when GL∈[64-352], A=0.96, B=65.11, and C=45.67; and when GL∈[352-1016], A=0.9, B=87.67, and C=33.69.

Then the finally-obtained association relationship between the input gray scale values and the correction gray scale values of the display apparatus is that:

$$GL' = \begin{cases} 1.49GL + 17.31 * \left[1 - e^{-GL/3.06}\right], GL \in [0 - 64] \\ 0.96GL + 65.11 * \left[1 - e^{-GL/45.67}\right], GL \in [64 - 352] \\ 0.9GL + 87.67 * \left[1 - e^{-GL/33.69}\right], GL \in [352 - 1016] \end{cases}.$$

Moreover, when establishing the association relationship, an interpolation method can also be used, and based on the actual measured data of the test gray scale values and the test-correction gray scale values, by numerical processing software, the association relationship therebetween can be simply and rapidly generated, and thus, examples will not be given out in detail in the embodiments of the present disclosure.

Figure 2:
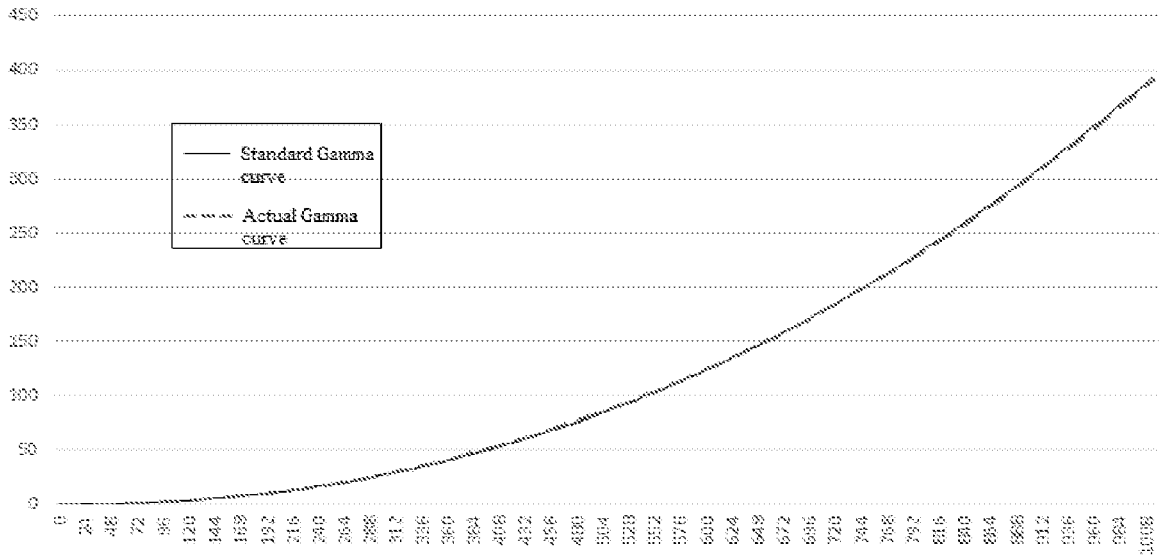
FIG. 2 is a comparison chart of a standard Gamma curve and an actual Gamma curve provided by an embodiment of the present disclosure.

In the step S105, according to the above-mentioned obtained association relationship between the input gray scale values and the correction gray scale value of the display apparatus, by arranging a correction module or an arithmetic circuit in the display apparatus, the input gray scale value of the display apparatus is adjusted to the correction gray scale value in real time so as to achieve the technical effects of the present disclosure. With reference to FIG. 2, FIG. 2 is a comparison chart of the standard Gamma curve and an actual Gamma curve, which is provided by an embodiment of the present disclosure, wherein a solid line is the standard Gamma curve (Gamma 2.2 curve); a dotted line is the actual Gamma curve (which is drawn using the correction gray scale values and the target brightness). It is thus clear that the actual Gamma curve used in the actual working process of the display apparatus has been very close to the standard Gamma curve. In other words, the method disclosed by embodiments of the present disclosure effectively achieves the effect of correcting the Gamma curve, and can promote the quality of the output image of the display apparatus.

Figure 3:
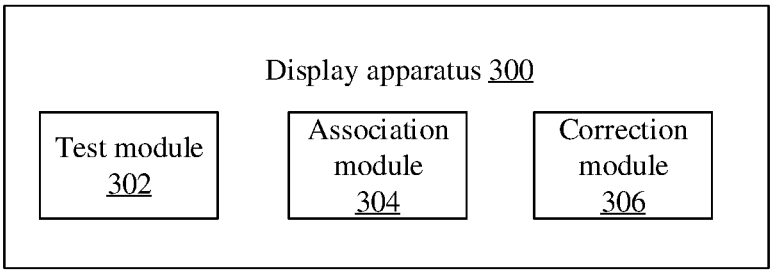
FIG. 3 is a schematic block diagram of a display apparatus provided by an embodiment of the present disclosure.

In another aspect, as shown in FIG. 3, an embodiment of the present disclosure further provides a display apparatus 300 that applies the Gamma-curve correction method according to the above-mentioned embodiments of the present disclosure. The display apparatus 300 includes: a correction module 306, which is configured to adjust an input gray scale value of the display apparatus to a corresponding correction gray scale value according to an association relationship between input gray scale values and correction gray scale values of the display apparatus.

For example, the display apparatus further includes a test module 302 and an association module 304.

The test module 302 is configured to: determine a standard Gamma curve according to the display apparatus; select a plurality of test gray scale values on the standard Gamma curve, and acquire a plurality of target brightness values corresponding to the plurality of test gray scale values; and adjust input gray scale values of the display apparatus to obtain a plurality of test-correction gray scale values, wherein the test-correction gray scale values are the corresponding input gray scale values when display brightness of the display apparatus is equal to the target brightness.

The association module 304 is configured to, according to the plurality of test gray scale values and the plurality of test-correction gray scale values, generate the association relationship between the input gray scale values and the correction gray scale values of the display apparatus.

For example, the test module 302 is configured to select the plurality of test gray scale values at a fixed preset interval on the standard Gamma curve. For example, the fixed preset interval is equal to 4 or 8 gray scale units.

For example, the test module 302 is configured to: select test gray scale values in a low-gray-scale region and/or a high-gray-scale region of the standard Gamma curve at a first preset interval, and select test gray scale values in other regions of the standard Gamma curve at a second preset interval, the first preset interval being smaller than the second preset interval.

For example, the association module 304 is configured to generate the association relationship between the input gray scale values and the correction gray scale values of the display apparatus by a fitting method. For example, the association relationship is that:

$$GL' = A*GL + B*[1 - e^{-GL/C}],$$

where GL' represents a correction gray scale value, GL represents an input gray scale value of the display apparatus, and A, B and C represent constant coefficients determined by the fitting method.

For example, the association module 304 is configured to generate the association relationship between the input gray scale values and the correction gray scale values of the display apparatus by an interpolation method.

For example, the display apparatus 300 further includes a display panel with a display function and/or a touch function. In an embodiment, a type of the display apparatus and a display technology applied by the display apparatus are not specifically defined. The display apparatus may be a liquid crystal panel, a liquid crystal display, a liquid crystal television, an Organic Light Emitting Diode (OLED) panel, an OLED display, an OLED television or electronic paper and the like.

The display apparatus provided by an embodiment of the present disclosure may further include one or more processors and one or more memories. The processor may process data signals and may include various computing architectures such as a complex instruction set computer (CISC) architecture, a reduced instruction set computer (RISC) architecture or an architecture for implementing a combination of multiple instruction sets. The memory may store instructions and/or data executed by the processor. The instructions and/or data may include codes which are configured to achieve some functions or all the functions of one or more devices in the embodiments of the present disclosure. For instance, the memory includes a dynamic random access memory (DRAM), a static random access memory (SRAM), a flash memory, an optical memory or other memories well known to those skilled in the art.

In some embodiments of the present disclosure, the test module, the association module and the correction module include codes and programs stored in the memories; and the processors may execute the codes and the programs to achieve some functions or all the functions described above.

In some embodiments of the present disclosure, the test module, the association module and the correction module may be specialized hardware devices and configured to achieve some or all of the functions described above. For instance, the test module, the association module and the correction module may be a circuit board or a combination of a plurality of circuit boards and configured to achieve the above functions. In embodiments of the present disclosure, the circuit board or a combination of the plurality of circuit boards may include: (1) one or more processors; (2) one or more non-transitory computer-readable memories connected with the processors; and (3) processor-executable firmware stored in the memories.

An embodiment of the present disclosure further provides a storage medium, storing computer instructions suitable to operate by a processor, and when the computer instructions are operated by the processor, the above-mentioned Gamma-curve correction method for the display apparatus can be executed.

According to the Gamma-curve correction method for the display apparatus and the display apparatus, which are provided by the present disclosure, by carrying out actual use test on the display apparatus, the association relationship between the input gray scale values and the correction gray scale values, which particularly belongs to the display apparatus, is generated; and when the display apparatus operates, according to the association relationship, the input gray scale value of the display apparatus is adjusted to a corresponding correction gray scale value, thereby achieving the effect of carrying out correction on the Gamma curve, solving the technical problem of an inaccurate preset Gamma curve in an existing display apparatus and effectively promoting the quality of the output image of the display apparatus.

Those skilled in the art should understand that: discussions of any embodiment above merely is exemplary, but not intended to denote that the scope (including the claims) of the present disclosure is limited to those examples; and under the thoughts of the present disclosure, the above-mentioned embodiments or technical characteristics in different embodiments can also be combined, the steps can be implemented by a random sequence, there are many other variations in different aspects of the present disclosure as mentioned above, and for concision, those variations are not provided in details.

The embodiments of the present disclosure intend to include all such replacements, modifications or changes which fall within the broad scope of the appended claims. Therefore, any omissions, modifications, equivalent replacements, improvements and the like within the spirit and principle of the present disclosure shall be included in the scope of the present disclosure.

In the present disclosure, terms such as "first", "second" and the like used in the present disclosure do not indicate any sequence, quantity or significance but only for distinguishing different constituent parts. Also, the terms such as "a," "an," or "the" etc., are not intended to limit the amount, but indicate the existence of at least one. The terms "comprises," "comprising," "includes," "including," etc., are intended to specify that the elements or the objects stated before these terms and encompass the elements or the objects and equivalents thereof listed after these terms, but do not preclude the other elements or objects.

What are described above is related to the illustrative embodiments of the disclosure only and not limitative to the scope of the disclosure; any changes or replacements easily for those technical personnel who are familiar with this technology in the field to envisage in the scopes of the disclosure, should be in the scope of protection of the present disclosure. Therefore, the scopes of the disclosure are defined by the accompanying claims.

The present application claims the priority of the Chinese Patent Application No. 201710107355.4 filed on Feb. 27, 2017, which is incorporated herein by reference in its entirety as part of the disclosure of the present application.

The invention claimed is:

1. A Gamma-curve correction method for a display apparatus, comprising:

determining a standard Gamma curve according to the display apparatus;

selecting a plurality of test gray scale values on the standard Gamma curve, and calculating by the standard Gamma curve, to obtain a plurality of target brightness values corresponding to the plurality of test gray scale values;

adjusting an input gray scale value of the display apparatus to obtain a plurality of test-correction gray scale values, wherein the test-correction gray scale values are corresponding input gray scale values when display brightness of the display apparatus is equal to respective target brightness;

generating an association relationship between input gray scale values and correction gray scale values of the display apparatus, according to the plurality of test gray scale values and the plurality of test-correction gray scale values; and adjusting the input gray scale value of the display apparatus to a corresponding correction gray scale value, according to the association relationship.

2. The Gamma-curve correction method for the display apparatus according to claim 1, wherein selecting the plurality of test gray scale values on the standard Gamma curve includes: selecting the plurality of test gray scale values at a fixed preset interval on the standard Gamma curve.

3. The Gamma-curve correction method for the display apparatus according to claim 2, wherein the fixed preset interval is equal to 4 or 8 gray scale units.

4. The Gamma-curve correction method for the display apparatus according to claim 1, wherein selecting the plurality of test gray scale values on the standard Gamma curve includes: selecting test gray scale values in a low-gray-scale region of the standard Gamma curve at a first preset interval, and selecting test gray scale values in other regions of the standard Gamma curve at a second preset interval, the first preset interval being smaller than the second preset interval.

5. The Gamma-curve correction method for the display apparatus according to claim 1, wherein generating the association relationship between the input gray scale values and the correction gray scale values of the display apparatus includes: by a fitting method, generating the association relationship between the input gray scale values and the correction gray scale values of the display apparatus.

6. The Gamma-curve correction method for the display apparatus according to claim 5, wherein the association relationship includes:

$$GL'=A*GL+B*[1-e^{-GL/C}],$$

where GL' represents the correction gray scale value, GL represents the input gray scale value of the display apparatus, and A, B and C represent constant coefficients determined by the fitting method.

7. The Gamma-curve correction method for the display apparatus according to claim 1, wherein generating the association relationship between the input gray scale values and the correction gray scale values of the display apparatus includes: by an interpolation method, generating the association relationship between the input gray scale values and the correction gray scale values of the display apparatus.

8. The Gamma-curve correction method for the display apparatus according to claim 1, wherein selecting the plurality of test gray scale values on the standard Gamma curve includes:

selecting test gray scale values in a high-gray-scale region of the standard Gamma curve at a first preset interval, and selecting test gray scale values in other regions of the standard Gamma curve at a second preset interval, the first preset interval being smaller than the second preset interval.

9. The Gamma-curve correction method for the display apparatus according to claim 1, wherein selecting the plurality of test gray scale values on the standard Gamma curve includes:

selecting test gray scale values in a low-gray-scale region and a high-gray-scale region of the standard Gamma curve at a first preset interval, and selecting test gray scale values in other regions of the standard Gamma curve at a second preset interval, the first preset interval being smaller than the second preset interval.

10. A display apparatus for applying the Gamma-curve correction method according to claim 1, comprising: a correction module, configured to adjust an input gray scale value of the display apparatus to a corresponding correction gray scale value according to an association relationship between input gray scale values and correction gray scale values of the display apparatus.

11. The display apparatus according to claim 10, further comprising a test module and an association module, wherein:

the test module is configured to:

determine a standard Gamma curve according to the display apparatus;

select a plurality of test gray scale values on the standard Gamma curve, and acquire a plurality of target brightness values corresponding to the plurality of test gray scale values; and adjust the input gray scale value of the display apparatus to obtain a plurality of test-correction gray scale values, wherein the test-correction gray scale values are corresponding input gray scale values when display brightness of the display apparatus is equal to respective target brightness; and the association module is configured to, according to the plurality of test gray scale values and the plurality of test-correction gray scale values, generate the association relationship between the input gray scale values and the correction gray scale values of the display apparatus.

12. The display apparatus according to claim 11, wherein the test module is configured to select the plurality of test gray scale values at a fixed preset interval on the standard Gamma curve.

13. The display apparatus according to claim 11, wherein the test module is configured to: select test gray scale values in a low-gray-scale region of the standard Gamma curve at a first preset interval, and select test gray scale values in other regions of the standard Gamma curve at a second preset interval, the first preset interval being smaller than the second preset interval.

14. The display apparatus according to claim 11, wherein the association module is configured to generate the association relationship between the input gray scale values and the correction gray scale values of the display apparatus by a fitting method.

15. The display apparatus according to claim 14, wherein the association relationship includes:

$$GL'=A*GL+B*[1-e^{-GL/C}],$$

where GL' represents the correction gray scale value, GL represents the input gray scale value of the display apparatus, and A, B and C represent constant coefficients determined by the fitting method.

16. The display apparatus according to claim 11, wherein the association module is configured to generate the association relationship between the input gray scale values and the correction gray scale values of the display apparatus by an interpolation method.

17. The display apparatus according to claim 11, wherein the test module is configured to:

select test gray scale values in a high-gray-scale region of the standard Gamma curve at a first preset interval, and select test gray scale values in other regions of the standard Gamma curve at a second preset interval, the first preset interval being smaller than the second preset interval.

18. The display apparatus according to claim 11, wherein the test module is configured to:

select test gray scale values in a low-gray-scale region and a high-gray-scale region of the standard Gamma curve at a first preset interval, and select test gray scale values in other regions of the standard Gamma curve at a second preset interval, the first preset interval being smaller than the second preset interval.

19. A non-transitory storage medium, storing computer instructions suitable to be executed by a processor, wherein when the computer instructions are executed by the processor, the Gamma-curve correction method for the display apparatus according to claim 1 is executed.

* * * * *